US007213650B2

(12) United States Patent
Lehman et al.

(10) Patent No.: US 7,213,650 B2
(45) Date of Patent: May 8, 2007

(54) SYSTEM AND METHOD FOR SCALE REMOVAL IN OIL AND GAS RECOVERY OPERATIONS

(75) Inventors: Lyle V. Lehman, Katy, TX (US); James R. Birchak, Spring, TX (US); James S. Venditto, Ruwi (OM); Diederik van Batenburg, Delft (NL); Sau-Wai Wong, Houston, TX (US); Frederick van de Bas, Schiedam (NL); Jeroen J. Groenenboom, Den Haag (NL)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/702,799

(22) Filed: Nov. 6, 2003

(65) Prior Publication Data

US 2005/0098319 A1 May 12, 2005

(51) Int. Cl.
*E21B 37/00* (2006.01)
*E21B 28/00* (2006.01)

(52) U.S. Cl. ..... 166/304; 166/177.6

(58) Field of Classification Search ..... 166/304, 166/177.6, 242.1, 250.03, 250.05, 249, 311
See application file for complete search history.

(56) References Cited

U.S. PATENT DOCUMENTS 4,393,932 A 7/1983 Bodine
4,665,980 A 5/1987 Bodine
4,718,774 A * 1/1988 Slough ..... 374/7
5,273,114 A 12/1993 Wicks, III et al.
5,282,508 A * 2/1994 Ellingsen et al. ..... 166/249
5,595,243 A * 1/1997 Maki et al. ..... 166/177.2
5,676,213 A * 10/1997 Auzerais et al. ..... 175/58
5,969,235 A * 10/1999 Allan ..... 73/61.62
6,230,802 B1 * 5/2001 Duhon ..... 166/278
6,554,064 B1 4/2003 Restarick et al.
6,557,634 B2 5/2003 Hailey, Jr. et al.
6,691,778 B2 * 2/2004 Cole et al. ..... 166/249
6,814,141 B2 * 11/2004 Huh et al. ..... 166/249
6,877,561 B2 * 4/2005 Richard et al. ..... 166/278
6,886,406 B1 * 5/2005 Couet et al. ..... 73/579
2002/0153135 A1 * 10/2002 Troutt et al. ..... 166/249
2005/0028983 A1 * 2/2005 Lehman et al. ..... 166/311

OTHER PUBLICATIONS

Brian Champion, et al., "The Application of High Power Sound Waves for Wellbore Cleaning," SPE 82197, at 1-10, dated May, 2003.

Article entitled "Ultrasonic Reduction of Wellbore Deposits and Formation Damage," Ultrasonic, dated Feb. 6, 1998, pp. 1-5, http://www.ees4.lanl.gov/ultrasonics/.

(Continued)

*Primary Examiner*—Kenneth Thompson
(74) *Attorney, Agent, or Firm*—John W. Wustenberg; Haynes & Boone, L.L.

(57) ABSTRACT

A system and method for stimulating a formation surrounding a well and vibrating a device for supporting a gravel pack in the well, according to which a build up of scale on the device is sensed and a corresponding signal is output. A driver is provided for driving a transducer coupled to the device for vibrating the device and removing scale from the device.

32 Claims, 2 Drawing Sheets

OTHER PUBLICATIONS

Article entitled "Field Testing Considerations for Ultrasonic Cleaning Tool," Ultrasonics, p. 1-2, http://www.ees4.lanl.gov/ultrasonics/Test_Criteria.html.

Brochure entitled "The Tool," Ultrasonics, http://www.ees4.lanl.gov/ultrasonics/TOOLSPECS.JPG.

SPE Paper entitled "High Power/High Frequency Acoustic Stimulation—A Novel And Effective Wellbore Stimulation Technology", by Sau-Wai Wong et al., dated Oct. 2003.

Paper entitled "Ultrasonic Removal of Organic Deposits and Polymer-Induced Formation Damage", by P.M. Roberts et al., dated Mar. 2000.

SPE Paper entitled "Ultrasonic Removal of Near-Wellbore Damage Caused By Fines and Mud Solids", by Adinathan Venkitaraman et al., dated Feb. 1994.

SPE Paper entitled "Near Wellbore Stimulation by Acoustic Waves", by Sau-Wai Wong et al., dated May 2003.

United States Patent Application entitled Vibrating System and Method for Use In Stand Control and Formation Stimulation In Oil and Gas Recovery Operations, U.S. Appl. No. 10/650,186, filed Aug. 28, 2003, by Lyle V. Lehman et al.

* cited by examiner

SYSTEM AND METHOD FOR SCALE REMOVAL IN OIL AND GAS RECOVERY OPERATIONS

BACKGROUND

This invention relates to a vibrating device for use in sand control and formation stimulation in an oil and gas recovery operation.

Many oil and gas downhole recovery operations, especially high-rate, high-permeability completions, produce reservoir fluids that contain fines, or formation sand. Therefore, support and screening devices, such as screens, slotted liners, and the like, have been utilized to support gravel packs, or the like, in the well to stabilize the formation while permitting the recovered fluids to pass from the formation into the wellbore while preventing passage of fines or formation sand with the recovered fluids.

These support devices are often placed in a pressure-drop zone that subjects the devices to contamination from scaling (salt crystal growth) and other materials that are precipitated during production of the reservoir fluids (hereinafter collectively referred to as "scale"). Thus, the scale must be removed from the devices either mechanically, which adds to the labor and cost of the project, or chemically, which may harm the metal parts of the devices. Also, during the recovery operation from the wellbore, a "skin" develops around the wall of the wellbore that impedes the flow of fluid from the formation thus requiring techniques to remove the skin.

Therefore, what is needed is a device of the above type that simultaneously performs the above screening as well as the scale and skin removal functions, yet eliminates the above problems.

DETAILED DESCRIPTION

Figure 1:
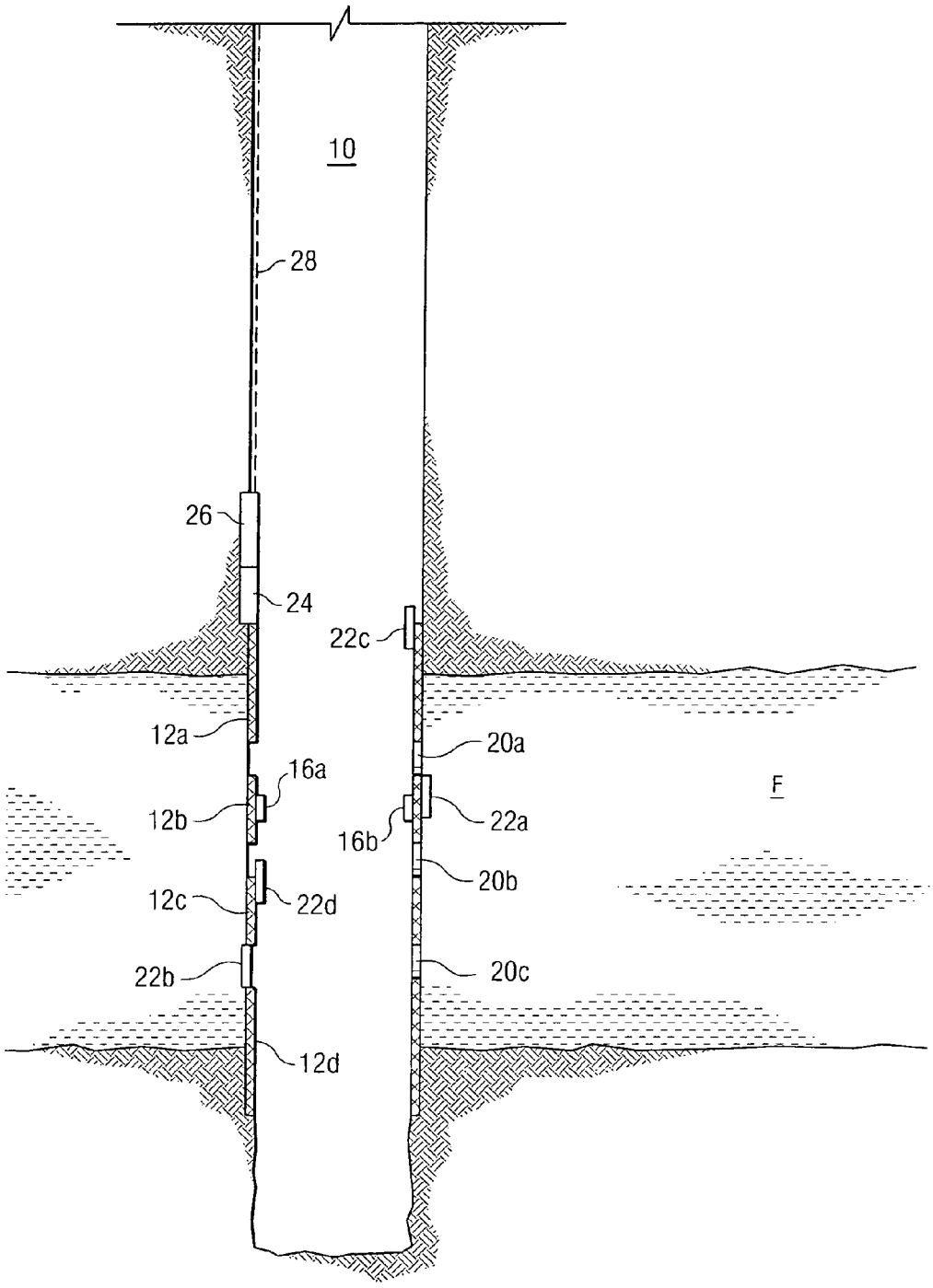
FIG. 1 is a diagrammatic view of an embodiment of a sand control system of the present invention shown in a downhole environment.

Referring to FIG. 1 of the drawings, the reference 10 refers, in general, to a wellbore 10 that penetrates a producing formation F. It is also understood that a casing (not shown) can be provided in the wellbore 10 and that production tubing (not shown) is installed in the wellbore 10.

Four axially-spaced, cylindrical gravel pack support and screening devices 12*a*–12*d* are mounted, in any conventional manner, to the wall of the wellbore 10 adjacent the formation F. The devices 12*a*–12*d* can be in the form of screens, slotted liners, or any similar type of gravel support device. Although not clear from the drawing due to scale limitations, it is understood that the devices 12*a*–12*d* define an annular space with the wall of the wellbore 10 that receives one or more gravel packs, or the like, (not shown). The purpose of each gravel pack is to improve the integrity of the wall of the wellbore 10, yet allow recovered fluids to pass to and through the devices 12*a*–12*d* and into the wellbore, while preventing the passage of fines or sand from the fluids. Since these gravel packs are conventional, they will not be described in any further detail.

Two electrical drivers 16*a* and 16*b* are mounted on the inner wall of the device 12*b* in a diametrically opposed relationship. The drivers 16*a* and 16*b* are conventional and, as such, are connected to a source of AC or DC power in a manner to be described and are adapted to supply electrical power, for reasons to be described.

A transducer 20*a* is mounted on the wall of the wellbore 10 between the devices 12*a* and 12*b*; a transducer 20*b* is mounted on the wall of the wellbore 10 between the devices 12*b* and 12*c*; and a transducer 20*c* is mounted on the wall of the wellbore 10 between the devices 12*c* and 12*d*. The transducers 20*a*–20*c* can be in the form of conventional electromechanical transducers, or converters, such as tuning forks, cantilevers, oval-mode tools, magnetostrictive drivers, or piezoelectric transducers. It is understood that each transducer 20*a*–20*c* is electrically connected to one of the drivers 16*a* or 16*b* so that it can be driven by the electrical power output from the driver to cause the transducer to vibrate accordingly.

The transducers 20*a*–20*c* are designed to operate at a desired, predetermined frequency, and preferably at their resonate frequency. For example, one or more of the transducers 20*a*–20*c* can be designed to operate at a relatively high resonate frequency; while the other transducer(s) can operate at a relatively low resonate frequency. As a non-limitative example, if the desired frequency is above 4 kHz, the transducers 20*a* and 20*b* can be in the form of piezoelectric transducers, such as those marketed under the designation PZT-4 by the Edo Corporation of Salt Lake City, Utah. In this case, the transducers 20*a* and 20*b* are connected to the driver 16*a* and the frequency, or frequencies, of the output of the driver 16*a* is matched to the resonate frequencies of the transducers 20*a* and 20*b* so that they are driven at their resonate frequencies. If it is desired to operate below 4 kHz, the transducers 20*c* and 20*d* can be in the form of conventional magnetostrictive drivers that are connected to the driver 16*b*, in which case the frequency, or frequencies, of the output of the driver 16*b* is matched to the resonate frequencies of the transducers 20*c* and 20*d* so that they are also driven at their resonate frequencies.

The transducers 20*a*–20*c* are mechanically coupled to the devices 12*a*–12*d* in a manner so that vibrations of the transducers 20*a*–20*c* are imparted to the devices 12*a*–12*d*. The coupling is such that the devices 12*a* and 12*b* provide equal and opposite loads on the transducer 20*a*, so that it can be used to vibrate the devices 12*a* and 12*b* simultaneously. Similarly, the devices 12*b* and 12*c* provide equal and opposite loads on the transducer 20*b* so that it can be used to vibrate the devices 12*b* and 12*c* simultaneously; and the devices 12*c* and 12*d* provide equal and opposite loads on the transducer 20*c* so that it can be used to vibrate the devices 12*c* and 12*d* simultaneously.

A sensor 22*a* is mounted to the outer surface of the device 12*b* and a sensor 22*b* is mounted between the outer surfaces of the devices 12*c* and 12*d*. Also, two axially spaced sensors 22*c* and 22*d* are mounted to the inner surfaces of the devices 12*a* and 12*c*, respectively. The sensors 22*a* and 22*b* are adapted to sense pertinent downhole data, such as pressure and temperature, outside the devices 12*a*–12*d*, and the sensors 22*c* and 22*d* are adapted to sense the same data inside the devices.

A control unit 24, which can include, or be in the form of, a microprocessor, or the like, is mounted to the upper end of the device 12*a*. Although not shown in the drawings in the interest of clarity, it is understood that the control unit 24 is electrically connected to the sensors 22*a*–22*d* so that the data sensed by the sensors 22*a*–22*d* is transferred to the control unit 24. The control unit 24 is adapted to process signals from the sensors 22*a*–22*d* and generate corresponding output signals. The drivers 16*a* and 16*b* are also connected to the control unit 24 so that the control unit 24 can provide a signal to the drivers 16*a* and 16*b* to enable them to drive the transducers 20*a*–20*c*.

A telemetry device 26 is mounted on the upper end of the control unit 24. The telemetry device 26 is electrically connected to the control unit 24 and, as such, is adapted to collect the data from the control unit 24 and transmit the data to the ground surface. Since the telemetry device 26 is conventional, it will not be described in detail.

It is understood that the devices 12*a*–12*d*, the drivers 16*a* and 16*b*, the transducers 20*a*–20*c*, the sensors 22*a*–22*d*, the control unit 24, and the telemetry device 26 can be assembled as a single unitary package before being inserted in the wellbore 10 in a conventional manner.

A cable assembly 28, shown by a dashed line, extends from the ground surface to the telemetry device 26 and to the control unit 24. It is understood that the cable assembly 28 includes electrical conductors for supplying electrical power from the ground surface. Although not shown in the drawings in the interest of clarity, it is also understood that the cable assembly 28 extends to drivers 16*a* and 16*b* and the sensors 22*a*–22*d* to also power these units.

In operation, the package consisting of the devices 12*a*–12*d*, the drivers 16*a* and 16*b*, the transducers 20*a*–20*c*, the sensors 22*a*–22*d*, the control unit 24 and the telemetry device 26 is inserted in, and mounted to, the wellbore 10 adjacent the formation F as shown in FIG. 1. The devices 12*a*–12*d* are packed with sand, or the like, to form gravel packs and production is started. Fluids recovered from the formation F pass through the gravel packs and the devices 12*a*–12*d* and upwardly in the wellbore 10 to the above-mentioned production tubing (not shown) for passing to the ground surface, while the devices 12*a*–12*d* prevent fines or sand from the fluids from passing with the fluids.

The sensors 22*a* and 22*b* sense the pertinent downhole data, such as pressure and temperature, outside the devices 12*a*–12*d*, and the sensors 22*c* and 22*d* sense this data inside the devices 12*a*–12*d*. Each sensor 22*a*–22*d* generates corresponding signals that are transmitted to the control unit 24. The control unit 24 processes and analyzes the above signals and is programmed to respond when the fluid pressure outside the devices 12*a*–12*d* exceeds the fluid pressure inside the devices 12*a*–12*d* by a predetermined amount, indicating that the devices 12*a*–12*d* are at least partially clogged with scale. When this happens, the control unit 24 sends a corresponding signal to the drivers 16*a* and 16*b* to activate them.

The power output from the drivers 16*a* and 16*b* drive their corresponding transducers 20*a*–20*c* to cause corresponding vibration of the transducers 20*a*–20*c* and therefore the devices 12*a*–12*d* at their resonate frequency in the manner discussed above. These vibrations fracture, or break up, the scale accumulating on the devices 12*a*–12*d*. The scale and/or materials recovered from the devices 12*a*–12*d* are allowed to fall to the bottom of the wellbore 10, or could be circulated, in any conventional manner, to the ground surface for recovery. In the meantime, the downhole data from the control unit 24 is transmitted to the telemetry device 26 which, in turn, transmits it to the ground surface for monitoring and/or processing.

The output from the transducers 20*a*–20*c* can be in a frequency range that also stimulates the formation F adjacent the devices 12*a*–12*d* and reduces the "skin" around the wellbore 10 that can slow the flow of production fluid from the formation to the wellbore.

As a result of all of the foregoing, scale accumulating on the devices 12*a*–12*d* is broken up without causing any physical or chemical damage to the devices 12*a*–12*d*, while the formation F is stimulated and the skin around the wellbore 10 is reduced.

The above operation can be terminated after a predetermined amount of time or after the control unit 24 ceases sending the above signal to the drivers 16*a*–16*b* in response to data received from the sensors 22*a* and 22*b* indicating sufficient scale has been removed from the devices 12*a*–12*d*.

Figure 2:
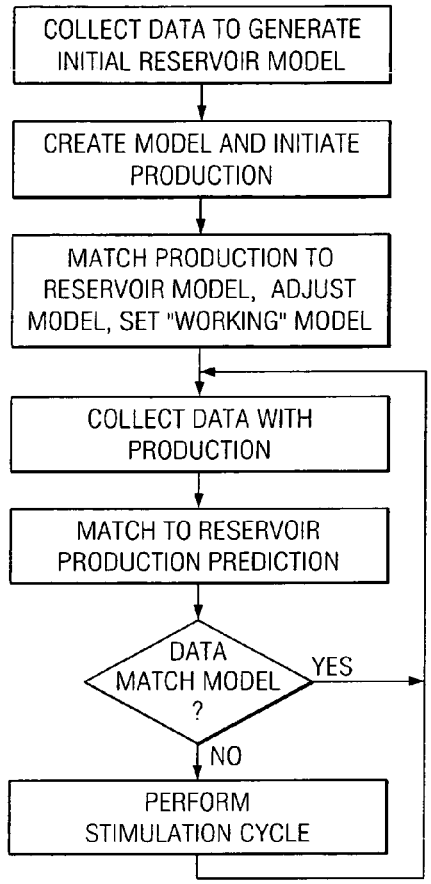
FIG. 2 is a flow chart depicting steps of a method according to an alternate embodiment of the invention.

According to another embodiment of the invention as shown in FIG. 2, the sensors 22*a*–22*d* are eliminated and a reservoir model can be utilized to provide information relating to the need to vibrate the devices 12*a*–12*d* in the above manner. Otherwise the embodiment of FIG. 2 contains the same components as the embodiment of FIG. 1. According to the embodiment of FIG. 2, data is initially collected to generate an initial reservoir model that is inputted to the control unit 24. After production of fluid from the formation F is initiated, the production information is generated and inputted to the control unit 24 which matches the information to the initial model and adjusts the model as necessary to set a working model. As production continues, the additional production data is collected and inputted to the control unit 24 which compares the data to the working model. If there is a match, the data is fed back to the control unit 24 for further processing; and, if there is no match, the drivers 16*a* and 16*b* are actuated to drive the transducers 20*a*–20*c* in the manner discussed above and thus initiate the vibration/production stimulation cycle described above.

Figure 3:
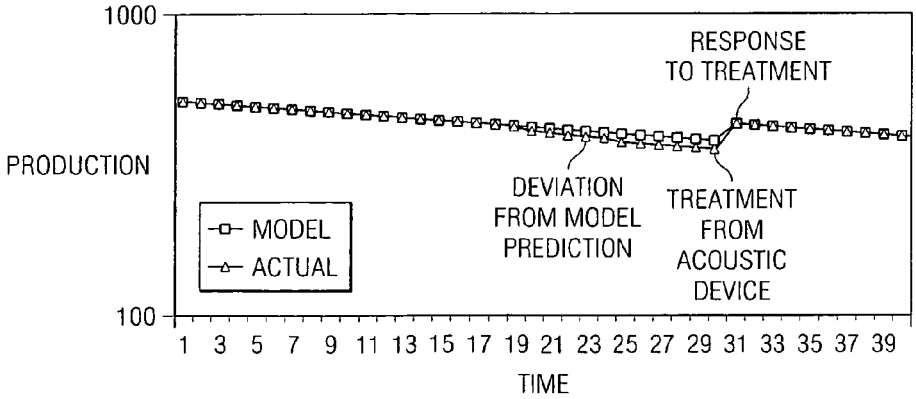
FIG. 3 is a graph depicting two variables in accordance with the embodiment of FIG. 2.

FIG. 3 is a graph of the simulated production from the wellbore 10 vs. time and shows the reservoir model of FIG. 2 by the rectangular data points, and a deviation from the model by the triangular data points, both before and after the scale is removed from the devices 12*a*–12*d* and the formation F is stimulated, including removal of the skin, in accordance with the foregoing method which can bring the production back to the model values.

Thus, the system and method according to the above embodiments performs the screening and stimulation functions yet eliminates the problems discussed above. Moreover, the above sensing, analysis, and treatment can be done simultaneously in real time.

Several variations may be made in both of the above embodiments without departing from the scope of the invention. These variations are as follows:

1. The control unit 24 can be programmed to adjust the pressure differential required to actuate the drivers 16*a* and 16*b*.

2. The number, type, and location of the screening devices 12*a*–12*d*, the drivers 16*a* and 16*b*, the transducers 20*a*–20*c*, and/or the sensors 22*a*–22*d* can be varied.

3. The sensors 22*a* and 22*b* could be eliminated and a scale sensor, or detector, could be mounted on each device 12*a*–12*d* to directly detect the presence of scale, and any other foreign materials, and generate a corresponding output signal that is transmitted to the control unit 24 for processing in the above manner.

4. The control unit 24 can be in the form of any type of data processing device.

5. The above connections between the control unit 24, the drivers 16*a* and 16*b*, and the sensors 22*a*–22*d*, the connections between the drivers 16*a* and 16*b* and the transducers 20*a*–20*c*, and the connection between the telemetry device 26 and the ground surface could be wireless.

6. The cable assembly 28 could be eliminated and a battery pack, or the like, could be provided downhole to supply electrical power to the various units.

7. Rather than use the reservoir model discussed in connection with FIG. 2 instead of the sensors 22*a* and 22*b*, the reservoir model could be used in addition to the sensors 22*a*–22*b*.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A system for use in a wellbore, comprising:

a device for supporting a gravel pack in the wellbore;

at least one transducer coupled to the device; and a driver mounted on the device and adapted to drive the transducer to vibrate the device and remove scale from the device, wherein there are at least two axially-spaced devices disposed in the wellbore and coupled to one transducer, so that the transducer vibrates both devices.

2. The system of claim 1 wherein the transducer is an electromechanical transducer that vibrates in response to an electrical signal.

3. The system of claim 2 wherein the transducer is selected from the group consisting of a tuning fork, a cantilever, an oval-mode tool, a magnetostrictive driver, and a piezoelectric transducer.

4. The system of claim 1 wherein the driver is connected to a source of AC or DC power and supplies an electrical power output that drives the transducer.

5. The system of claim 1 further comprising:

a sensor for sensing data associated with the device relating to the amount of scale on the device and outputting a signal when the scale exceeds a predetermined value; and means responsive to the signal for actuating the driver.

6. A system for use in a wellbore, comprising:

a device for supporting a gravel pack in the wellbore;

at least one transducer coupled to the device;

a driver mounted on the device and adapted to drive the transducer to vibrate the device and remove scale from the device;

a sensor for sensing pressure and temperature inside and outside the device and outputting a signal when the pressure and/or temperature exceed a predetermined value; and means responsive to the signal for actuating the driver.

7. The system of claim 6 wherein the sensor is a scale detector.

8. The system of claim 6 wherein the actuating means comprises a control unit connected to the sensor and to the driver for activating the driver to drive the transducer in response to the signal.

9. A system for use in a wellbore, comprising:

a device for supporting a gravel pack in the wellbore;

at least one transducer coupled to the device;

a driver mounted on the device and adapted to drive the transducer to vibrate the device and remove scale from the device;

a sensor for sensing data associated with the device relating to the amount of scale on the device and outputting a signal when the scale exceeds a predetermined value;

a control unit connected to the sensor and to the driver for activating the driver to drive the transducer in response to the signal; and a telemetry device for collecting data from the control unit and transmitting the data to the ground surface for monitoring and/or processing.

10. The system of claim 9 wherein vibration of the device stimulates a formation penetrated by the wellbore.

11. The system of claim 9 wherein the device screens gravel from the gravel pack.

12. The method of claim 9 wherein the data relates to the amount of scale on the device.

13. A method comprising the steps of:

providing a device downhole in a wellbore;

sensing data associated with the device, the data including pressure and temperature inside and outside the device;

outputting a signal when the sensed data reaches a predetermined value;

coupling at least one transducer to the device;

mounting a driver on the device; and activating the driver in response to the signal for vibrating the transducer and the device to remove scale from the device.

14. The method of claim 13 further comprising the step of transmitting the data to the ground surface for monitoring and/or processing.

15. The method of claim 13 wherein vibration of the device stimulates a formation penetrated by the wellbore.

16. The method of claim 13 further comprising the steps of:

transmitting the signal to a control unit; and processing the signal at the control unit, wherein the step of activating is done by the control unit.

17. The method of claim 16 wherein the steps of sensing, processing, and activating are done simultaneously.

18. A method comprising the steps of:

providing a device downhole in a wellbore;

supporting a gravel pack with the device;

sensing data associated with the device;

outputting a signal when the sensed data reaches a predetermined value;

coupling at least one transducer to the device;

mounting a driver on the device;

activating the driver in response to the signal for vibrating the transducer and the device to remove scale from the device.

19. A method comprising the steps of:

providing a device downhole in a wellbore;

sensing data associated with the device;

outputting a signal when the sensed data reaches a predetermined value;

coupling two axially-spaced transducers to the device;

mounting a driver on the device; and activating the driver in response to the signal for vibrating the transducers and the device to remove scale from the device.

20. A system for use in a wellbore, comprising:

a screen that supports a gravel pack in the wellbore;

first means coupled to the screen for vibrating the screen to remove scale from the screen; and second means mounted on the first means for activating the first means in response to a condition of the screen.

21. A system for use in a wellbore, comprising:

a screen that supports a gravel pack in the wellbore;

first means coupled to the screen for vibrating the screen;

a transducer mounted on the first means and adapted to vibrate the first means in response to a condition of the screen.

22. The system of claim 21 further comprising means for supplying power to the transducer for activating and driving the transducer.

23. The system of claim 21 wherein the transducer is selected from the group consisting of a tuning fork, a cantilever, an oval-mode tool, a magnetostrictive driver, and a piezoelectric transducer.

24. The system of claim 21 further comprising a driver that produces an electrical power output that drives the transducer.

25. A system for use in a wellbore, comprising at least two axially-spaced devices disposed in the wellbore;

a transducer coupled to the devices for vibrating the devices; and means mounted on the devices for activating the transducer in response to a condition of at least one of the devices.

26. A system for use in a wellbore, comprising:

first means in the wellbore;

second means coupled to the first means for vibrating the first means; and third means mounted on the first means for activating the second means in response to the amount of scale on the first means;

sensing means for sensing data related to the amount of scale on the first means and outputting a signal when the data reaches a predetermined value; and control means responsive to the signal for actuating the third means.

27. The system of claim 26 wherein the data includes pressure and temperature inside and outside the device.

28. The system of claim 27 further comprising telemetry means for collecting the data from the control means and transmitting the data to the ground surface for monitoring and/or processing.

29. The system of claim 26 wherein the sensing means is a scale detector.

30. The system of claim 26 wherein the control means is connected to the sensing means and to the third means for activating the third means in response to the signal.

31. A system for use in a wellbore, comprising:

a screen that supports a gravel pack in the wellbore;

a transducer coupled to the screen and adapted to vibrate in response to receiving power to cause corresponding vibration of the screen; and means mounted on the screen for activating the transducer in response to a condition of the screen.

32. The system of claim 31 wherein the vibration stimulates the recovery of oil and/or gas.

* * * * *